US008479889B2

(12) United States Patent
Taavela

(10) Patent No.: US 8,479,889 B2
(45) Date of Patent: Jul. 9, 2013

(54) BUFFER ARRANGEMENT AND BUFFER STOP OF AN ELEVATOR

(75) Inventor: Juha Taavela, Lammi (FI)

(73) Assignee: Kone Corporation, Helsinki (FI)

( * ) Notice: Subject to any disclaimer, the term of this patent is extended or adjusted under 35 U.S.C. 154(b) by 358 days.

(21) Appl. No.: 12/796,081

(22) Filed: Jun. 8, 2010

(65) Prior Publication Data

US 2010/0243379 A1 Sep. 30, 2010

Related U.S. Application Data

(63) Continuation of application No. PCT/FI2008/000133, filed on Nov. 27, 2008.

(30) Foreign Application Priority Data

Dec. 17, 2007 (FI) ..... 20070987

(51) Int. Cl.
*B66B 5/28* (2006.01)
*B66B 11/02* (2006.01)
*B66B 5/16* (2006.01)

(52) U.S. Cl.
USPC ..... 187/344; 187/401; 187/356; 187/357

(58) Field of Classification Search
USPC ..... 187/356, 357, 294, 343, 360, 344, 187/401
IPC ..... B66B 5/28,5/00, 11/02, 11/04
See application file for complete search history.

(56) References Cited

U.S. PATENT DOCUMENTS

| | | | | |
|---|---|---|---|---|
| 4,512,444 | A * | 4/1985 | Koppensteiner | 188/67 |
| 6,481,534 | B1 * | 11/2002 | Malone, Jr. | 187/377 |
| 7,077,243 | B2 * | 7/2006 | Huber et al. | 187/357 |
| 7,281,609 | B2 * | 10/2007 | Del Rio Sanz et al. | 187/316 |
| 7,287,626 | B2 * | 10/2007 | Kigawa et al. | 187/344 |
| 2006/0042883 | A1 * | 3/2006 | Scott | 187/351 |
| 2007/0240942 | A1 * | 10/2007 | Sirigu | 187/360 |
| 2008/0245619 | A1 * | 10/2008 | Monzon-Simon et al. | 187/393 |
| 2008/0302612 | A1 * | 12/2008 | Beauchaud et al. | 187/344 |
| 2009/0183955 | A1 * | 7/2009 | Gonzalez Rodil et al. | 187/404 |

FOREIGN PATENT DOCUMENTS

| | | | |
|---|---|---|---|
| DE | 20119498 | U1 | 2/2002 |
| JP | 2001-302134 | A | 2/2001 |
| JP | 2006-298612 | A | 2/2006 |
| JP | 2006-69793 | A | 3/2006 |
| WO | WO 2005/105644 | A1 | 11/2005 |

* cited by examiner

*Primary Examiner* — William E Dondero
*Assistant Examiner* — Minh Truong
(74) *Attorney, Agent, or Firm* — Birch, Stewart, Kolasch & Birch, LLP

(57) ABSTRACT

A buffer arrangement of an elevator includes at least a buffer of the elevator and a buffer stop, which includes at least a stem part fixed to its base and a stop element with adjustable height position fitted in connection with the stem part. The stop element includes a stopping surface for the buffer of the elevator. An extension part is in connection with the buffer stop for increasing the height position of the stopping surface of the buffer stop.

8 Claims, 3 Drawing Sheets

BUFFER ARRANGEMENT AND BUFFER STOP OF AN ELEVATOR

Figure 1:
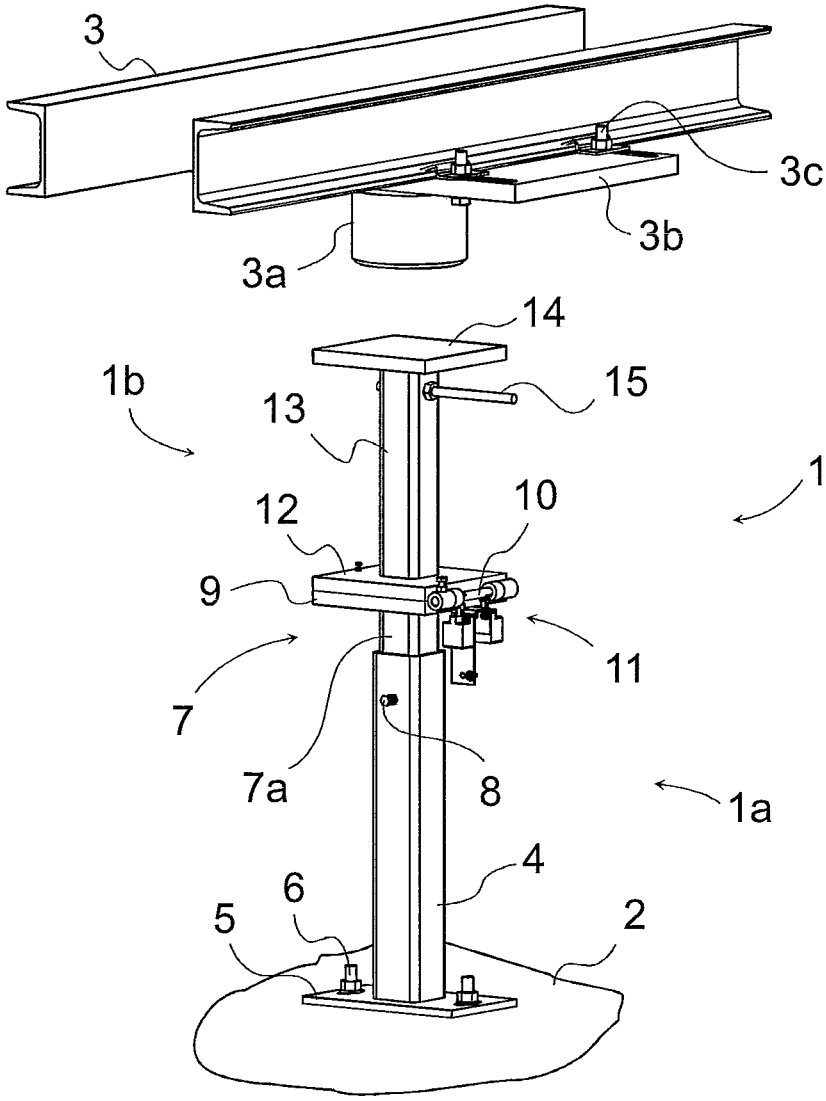

This application is a Continuation of copending PCT International Application No. PCT/FI2008/000133 filed on Nov. 27, 2008, and for which priority is claimed under 35 U.S.C. §120; and this application claims priority of Application No. 20070987 filed in Finland on Dec. 17, 2007 under 35 U.S.C. §119; the entire contents of all are hereby incorporated by reference into the present application.

The object of the invention is to provide a buffer arrangement of an elevator and a buffer stop of an elevator.

In old buildings the pit at the bottom of the elevator shaft often does not meet modern safety requirements, e.g. in connection with servicing the elevator, because the height of the pit is in many cases too small with respect to the new safety requirements. It is often necessary in connection with modernization to take the new safety requirements of elevators into use at the same time, in which case when the old pit at the bottom of the elevator shaft is too shallow it has been necessary to deepen it so that new and stricter safety requirements could be met. Deepening the pit is, however, expensive and essentially slow.

The purpose of this invention is to eliminate the aforementioned drawbacks and to achieve a simple and low-cost buffer arrangement of an elevator, which enables meeting new safety requirements also in elevators that are to be modernized. The purpose of the invention is also to achieve a buffer arrangement of an elevator, in which the buffer stop can be easily and quickly activated, the threshold for use of which is small and which enables an adequately high safety space, i.e. protective space, e.g. in connection with servicing of the elevator.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can in at least some situations be deemed to be inventive in their own right.

An advantage of the buffer arrangement according to the invention is that when modernizing an elevator the pit in the floor of the shaft of the elevator does not need to be deepened, in which case expensive and essentially slow modification work is avoided. The buffer arrangement according to the invention is also very inexpensive compared to the heavy hydraulic buffer solutions nowadays in use. One advantage is also the ability for rapid installation and the fact that the buffer stop according to the arrangement can be used also on the roof of the elevator car or of the elevator shaft as well as in connection with the counterweight. Yet another advantage is that activation of the buffer stop according to the arrangement is quick and easy, in which case the threshold for activation is small, owing to which the buffer stop will often be activated during servicing work and thus the work safety of servicemen will improve.

Figure 2:
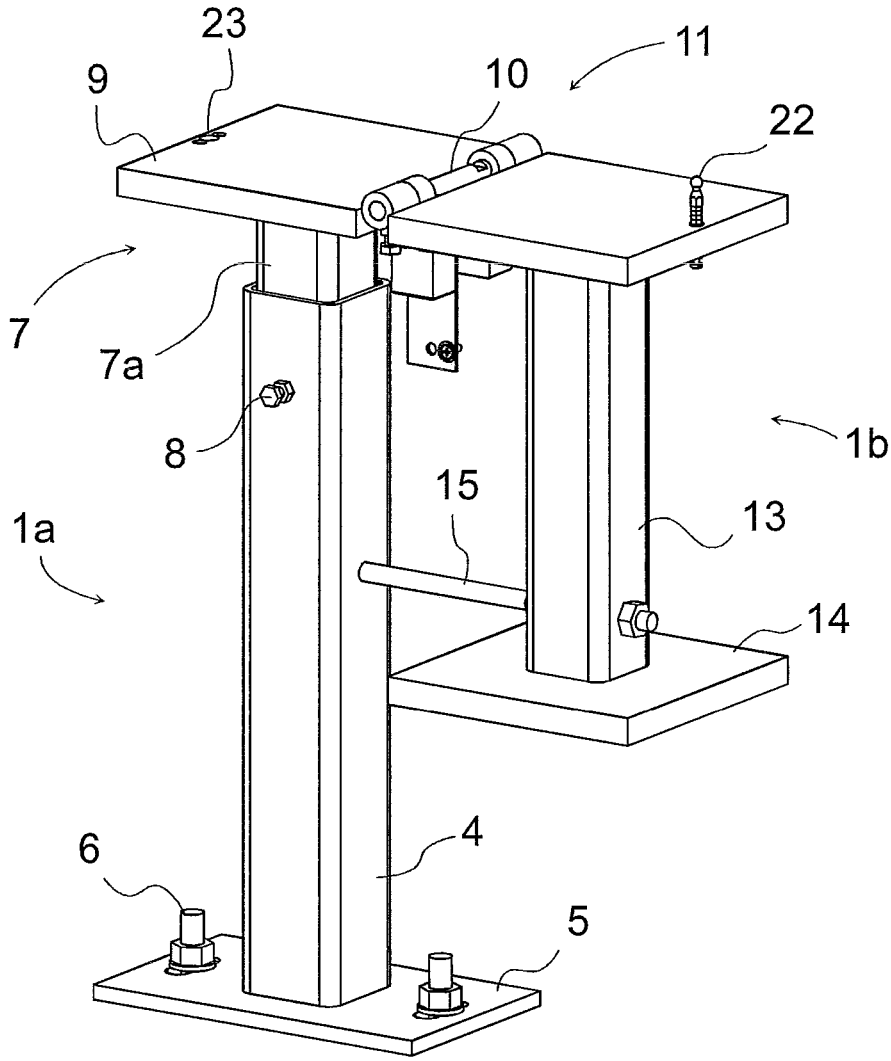
Figure 3:
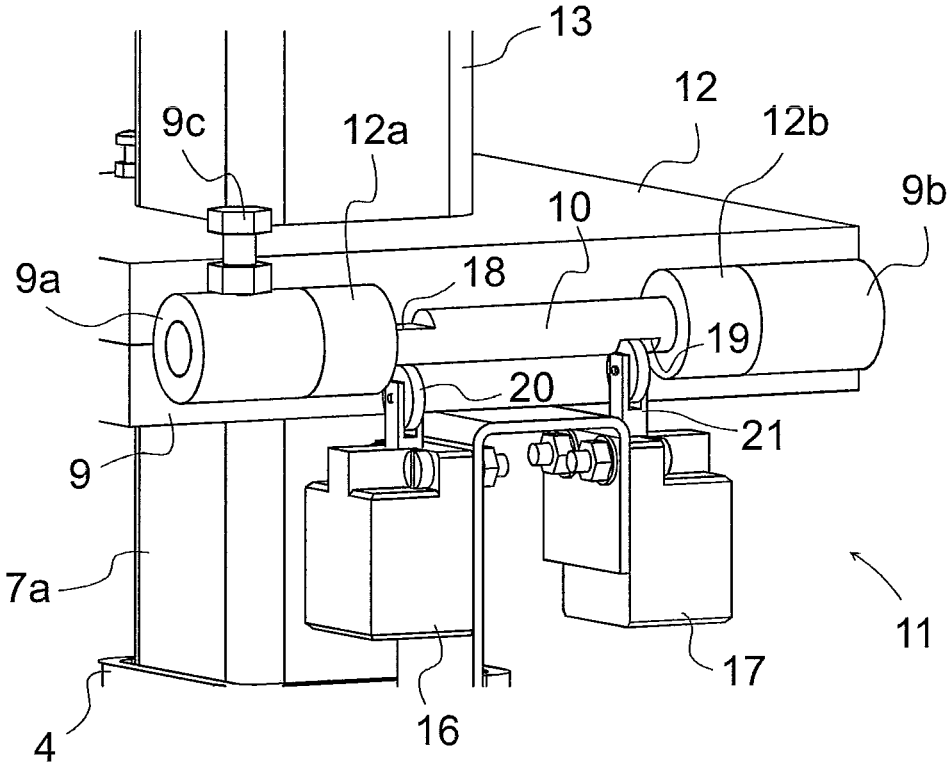

In the following, the invention will be described in detail by the aid of one example of its embodiment with reference to the attached drawings, wherein FIG. 1 presents a simplified and diagrammatic oblique top view of one buffer stop used in the arrangement according to the invention activated to service mode, FIG. 2 presents a simplified and diagrammatic oblique top view of a buffer stop according to FIG. 1 in normal drive mode and FIG. 3 presents a detail of the hinge structure of the buffer stop according to FIGS. 1 and 2 as viewed in the direction of the hinge.

FIG. 1 presents one buffer stop 1 used in the arrangement according to the invention when the elevator is in service mode. The buffer stop 1 is fixed in this solution e.g. to the floor 2 of the elevator shaft and disposed to point essentially vertically upwards. The other parts incorporated in the buffer arrangement are seen in FIG. 1 above the buffer stop 1, which parts are fixed to the bottom beams 3 of the car sling of the elevator car. The other parts are, among others, the actual buffer 3*a* as well as the mounting base 3*b* of the buffer and the fixing means 3*c*, with which the mounting base 3*b* is fixed to the bottom beams 3 of the car sling. The buffer 3*a* can be e.g. an elastomer buffer manufactured from polyurethane. The mounting base 3*b* of the buffer 3*a* is provided with e.g. elongated fixing holes, owing to which the mounting base 3*b* and at the same time the buffer 3*a* can be moved in the lateral direction into a better location, if e.g. there is not enough space directly in the center for the buffer stop 1 to behave in the manner according to the invention described below.

The buffer stop 1 of the buffer arrangement according to the invention comprises at least an elongated base part la and an extension part 1*b* that extends the length of the base part 1*a* in the height direction, i.e. in the direction of movement of the elevator car, which parts 1*a* and 1*b* are hinged to each other by means of a hinge element 11. The buffer stop 1 is disposed essentially directly below the path of movement of the buffer 3*a* such that in exceptional situations the buffer 3*a* hits the stopping surface of the buffer stop 1 preventing the elevator car from coming lower.

The base part 1*a* of the buffer stop 1 comprises at least a bottom flange 5 and an upward pointing hollow tubular stem part 4 fixed to it, which stem part 4 is e.g. square or rectangular piping. The stem part 4 is fixed via the bottom flange 5 and by means of the fixing elements 6 e.g. to the floor structure 2 of the elevator shaft. A stop element 7 provided with a telescopically moving vertical arm 7*a* is fitted inside the stem part 4, at the free end of which vertical arm 7*a*, i.e. at the top end in the solution presented here, is an upward pointing stop flange 9 provided with an essentially level stopping surface, against the stopping surface of which stop flange the elastomer buffer 3*a* is arranged to rest in the normal drive mode of the elevator if the elevator car for some reason drives so far downwards that the buffer 3*a* hits the stopping surface of the stop flange 9.

The position in the height direction of the stop element 7 and at the same time of the stop flange 9 is fitted to be adjustable by putting the desired amount of sand in the base of the hollow inside space of the stem part 4 of the base part 1*a* and by placing the vertical arm 7*a*, which is provided with a closed bottom end, of the stop element 7 to rest on the sand inside the stem part 4. In addition the stem part 4 comprises a locking screw 8 for locking the vertical arm 7*a* of the stop element 7 in position so that the stop element 7 could not e.g. accidentally be lifted out of its position.

The extension part 1*b* of the buffer stop 1 comprises an essentially straight tubular stem part 13, the first end of which, i.e. the end on the side of the base part 1*a*, comprises a plate-like support flange 12, and the other end of which, i.e. the free end, comprises a flange-like stopping element 14, which corresponds essentially in its size, shape and function to the stop flange 9 of the stop element 7 described above. The extension part 1*b* of the buffer stop 1 is hinged at one edge of the support flange 12 to one edge of the stop flange 9 of the stop element 7 by means of a hinge element 11 provided with a hinge pin 10.

FIG. 2 presents a buffer stop 1 according to FIG. 1 in the normal drive mode of the elevator. In this case the extension part 1*b* of the buffer stop 1 is bent by means of the hinge element 11 to the side such that the stopping surface of the stop flange 9 of the stop element 7 is fitted to receive a collision of the elastomer buffer 3*a* if the elevator car for some reason drives too far downwards. The stem part 13 of the extension part 1*b* comprises a support arm 15 at essentially a right angle with respect to the stem part 13, the length and position of which support arm is fitted to be such that when the extension part 1*b* is turned to the side out of the way of the stop flange 9, the free end of the support arm 15 rests on the outer surface of the stem part 4 of the base part 1*a* such that the arm 13 of the extension part 1*b* is in an essentially vertical position and the stopping surface of the stopping element 14 of the extension part 1*b* points downwards.

One edge of the support flange 12 of the extension part 1*b* also comprises a guide pin 22, which is fitted to correspond to the guide hole 23 on the edge of the stop flange 9 of the stop element 7 when the buffer stop 1 is activated for servicing or other corresponding procedure, such that the extension part 1*b* is turned onto the top of the base part la to extend the length of the base part 1*a* in the height direction. The purpose of the guide pin 22 and the guide hole 23 is to guide the extension part 1*b* to the correct position on top of the base part 1*a*. Preferably the guide pin 22 and the guide hole 23 are on the opposite edge with respect to the hinge element 11.

FIG. 3 presents the hinge element 11 in more detail. The hinge element 11 comprises e.g. at least the sleeve-like parts 9*a* and 9*b* that are provided with holes, which parts are fixed to one edge of the support flange 12 of the first end of the extension part 1*b*, and the sleeve-like parts 12*a* and 12*b* that are provided with holes, which parts are fixed correspondingly to one edge of the stop flange 9 of the stop element 7. The sleeve-like parts 9*a*, 9*b* and 12*a*, 12*b* are fixed in their position such that when the extension part 1*b* is in its position on top of the base part 1*a* the first sleeve-like parts 9*a* and 12*a* are side by side each other and correspondingly the second sleeve-like parts 9*b* and 12*b* are side by side each other as well as at a distance from the first sleeve-like parts. In addition the holes of all the sleeve-like parts 9*a*, 12*a*, 9*b* and 12*b* are essentially on the same axis, into which holes the shaft-like hinge pin 10 of the hinge element 11 is disposed, which hinge pin is locked into its correct attitude and position in the axial direction by means of the locking screw 9*c* e.g. through the sleeve-like part 9*a*. The hinge pin 10 is locked in its correct attitude to the first sleeve-like part 9*a* on the edge of the support flange 12 of the extension part 1*b* such that the hinge pin 10 rotates around its center axis as the extension part 1*b* is turned upwards or downwards.

The hinge pin 10 comprises two milled grooves 18 and 19 that narrow the hinge pin, in which the switch elements 20 and 21 of the position sensing switches 16 and 17 are disposed. The position sensing switches 16 and 17 are connected e.g. to the control system of the elevator and fitted to indicate to the control system of the elevator on the basis of the rotation of the hinge pin 10 in which position the extension part 1*b* of the buffer stop is at any time; either in normal drive mode, i.e. turned to the side and downwards, or in service mode, i.e. turned upright on top of the base part 1*a*.

The length of the extension part 1*b* is dimensioned with respect to the height of the base part 1*a* such that by means of the activation of the extension part 1*b* there is a possibility to increase the height of the protective space needed in connection with servicing of the elevator so that in a servicing situation or corresponding exceptional situation the height of the protective space or safety space according to safety requirements is reached if the pit has otherwise been too shallow e.g. in old buildings. Thus the combined height of the unextended buffer stop 1 and at the same time of the base part 1*a* and the extension part 1*b* of the buffer stop 1 is greater than or at least equal to the height of the safety space according to the safety requirements.

It is obvious to the person skilled in the art that the invention is not limited solely to the examples described above, but that it may be varied within the scope of the claims presented below. Thus for example the structure of the buffer and of the buffer stop can differ to what is presented above.

It is further obvious to the person skilled in the art that the buffer stop according to the invention can be disposed on the roof of the elevator car, on the roof of the elevator shaft or also under the counterweight instead of in the pit at the base of the elevator shaft.

It is also obvious to the person skilled in the art that the buffer stop according to the invention can be disposed in an inclined attitude with respect to its point-to-point measurement, in which case the extension part fits better for turning to the side or downwards in cramped locations.

It is further obvious to the person skilled in the art that the extension of the height of the buffer stop can be made in a different way to what is presented above. Thus in connection with extending the height it is possible to support the stop element e.g. with an extension arm provided with a hinge and a through-hole and the stop element can be lifted upwards by the necessary amount. In this case two different stopping surfaces are not needed, but instead the stopping surface of the stop element that operates in normal mode functions also as the stopping surface when the elevator is in service mode.

The invention claimed is:

1. A buffer arrangement of an elevator, comprising:

at least a buffer of the elevator; and a buffer stop, comprising:

at least a stem part fixed to a base thereof; and a stop element with adjustable height position with respect to the stem part adjustably coupled to the stem part, the stop element comprising a first stopping surface for the buffer of the elevator, and an extension part in connection with the first stopping surface configured to provide a second stopping surface being parallel with the first stopping surface and having a higher position than the first stopping surface with respect to the base, wherein the extension part is hinged at a first end thereof, opposite to a second end of the extension part forming the second stopping surface, by means of a hinge element to one edge of the first stopping surface; wherein the second stopping surface is configured to receive a collision of the buffer when the elevator is in service mode; and wherein in a normal drive mode of the elevator, the extension part of the buffer stop is configured to turn around the hinge element to a side of the first stopping surface of the buffer stop and at the same time to provide a third stopping surface, formed by the first end of the extension part, of the stop element of the buffer stop to receive a collision of the buffer.

2. The buffer arrangement according to claim 1, wherein in a service mode, the extension part of the buffer stop is configured to turn around the hinge element onto the first stopping surface of the buffer stop and at the same time to provide the second stopping surface thereof at the second end thereof to receive a collision of the buffer.

3. The buffer arrangement according to claim 2, further comprising position sensor switches in connection with the hinge element, the position sensor switches being connected to a control system of the elevator to indicate a current position of the extension part of the buffer stop.

4. The buffer arrangement according to claim 2, wherein a combined height of the unextended buffer stop and the extension part is greater than or at least equal to a height of a safety space according to safety requirements.

5. The buffer arrangement according to claim 1, further comprising position sensor switches in connection with the hinge element, the position sensor switches being connected to a control system of the elevator to indicate a current position of the extension part of the buffer stop.

6. The buffer arrangement according to claim 5, wherein a combined height of the unextended buffer stop and the extension part is greater than or at least equal to a height of a safety space according to safety requirements.

7. The buffer arrangement according to claim 1, wherein a combined height of the unextended buffer stop and the extension part is greater than or at least equal to a height of a safety space according to safety requirements.

8. The buffer arrangement according to claim 1, wherein the buffer is fixed to the elevator car by means of a mounting base that is adjustable in a lateral direction.

* * * * *